US005620087A

United States Patent [19]

Martin et al.

[11] Patent Number: 5,620,087

[45] Date of Patent: Apr. 15, 1997

[54] PRINTED LABEL STRUCTURE FOR PACKAGING ARRANGEMENTS

[75] Inventors: Wallace A. Martin, Orange Park; Richard W. Abrams, Jacksonville, both of Fla.; Ture Kindt-Larsen, Holte, Denmark; Daniel T.-F. Wang, Jacksonville, Fla.

[73] Assignee: Johnson & Johnson Vision Products, Inc., Jacksonville, Fla.

[21] Appl. No.: 257,795

[22] Filed: Jun. 10, 1994

[51] Int. Cl.[6] ..... B65D 81/24

[52] U.S. Cl. ..... 206/5.1; 206/459.5; 206/820

[58] Field of Search ..... 206/5.1, 205, 820, 206/459.5, 459.1; 134/901; 428/458, 349

[56] References Cited

U.S. PATENT DOCUMENTS

| | | | |
|---|---|---|---|
| 3,072,248 | 1/1963 | Bishop | 383/209 |
| 3,715,856 | 2/1973 | Borel | 206/820 X |
| 3,780,856 | 12/1973 | Braverman | 206/459.5 X |
| 4,195,787 | 4/1980 | Thomason | 206/459.5 X |
| 4,238,541 | 12/1980 | Burton | 206/820 X |
| 4,691,820 | 9/1987 | Martinez . | |
| 5,054,610 | 10/1991 | Ajello | 206/5.1 |
| 5,072,234 | 12/1991 | Crystal et al. | 428/458 X |
| 5,209,972 | 5/1993 | Super et al. | 428/458 X |

FOREIGN PATENT DOCUMENTS

| | | |
|---|---|---|
| 2403034 | 8/1975 | Germany . |
| 3005051 | 8/1981 | Germany . |

*Primary Examiner*—Bryon P. Gehman

[57] ABSTRACT

A cover-forming laminated structure interconnecting a plurality of containers, such as the base members of blister packages each of which is adapted to contain a hydrophilic contact lens in a sterile aqueous solution. More specifically, disclosed is an array of such containers which are interconnected by a single laminated multi-layered material constituting a covering label for the containers, wherein the material may be severed intermediate each of the containers along weakening lines formed by micro-perforations provided therein so as to provide a separate packaging arrangement. The material is imprinted over the surface extent thereof covering the plurality of containers with a specific pattern of indicia and legends configured with the intent of thwarting diverters upon separation of any of the packaging arrangements from the array, through visual evidence afforded by an inspection of the printing pattern.

39 Claims, 3 Drawing Sheets

PRINTED LABEL STRUCTURE FOR PACKAGING ARRANGEMENTS

BACKGROUND OF THE INVENTION

Field of the Invention

The present invention relates to a cover-forming laminated material structure interconnecting a plurality of containers, such as the base members of blister packages each of which is adapted to contain a hydrophilic contact lens in a sterile aqueous solution. More specifically, the invention pertains to an array of such containers which are interconnected by a unitary multi-layered laminated material constituting a covering label for the containers, wherein the laminate may be severed intermediate each of the containers along weakening lines provided therein so as to provide a separate packaging arrangement. The laminate is imprinted over the surface extent thereof on either one side of an outer layer covering the plurality of containers with a specific pattern of indicia and legends configured with the intent of thwarting diverters upon separation of any of the packaging arrangements from the array, through visual evidence afforded by an inspection of the printing pattern.

The packaging of hydrophilic contact lenses in a sterile aqueous solution is well known in the contact lens manufacturing technology. Particularly, packaging arrangements of that type generally consist of so-called blister packages adapted to be employed for the storage and dispensing of the hydrophilic contact lenses for use by a medical practitioner or a consumer who intends to wear the contact lenses. Such hydrophilic contact lenses, which may be disposable after a single wear or short-term use, are inexpensively manufactured from suitable hydrophilic polymeric materials; for example, copolymers of hydroxyethylene methacrylate containing from about 20% to 90% or more of water, depending upon a polymer composition. These contact lenses are generally stored in a sterile aqueous solution, ordinarily consisting of an isotonic saline solution, in order to prevent dehydration and to maintain the lenses in a ready-to-wear condition.

A container of the foregoing type, normally comprises a base member which is molded from a suitable injection-molded or thermoformed plastic material; for instance, such as polypropylene, and incorporates a cavity adapted to house the contact lens in the aqueous solution, and which is sealingly closed by a label-forming cover, preferably in the form of a flexible multi-layered laminated material structure to provide a so-called blister package. This type of packaging arrangement has found widespread use in view of the inherently advantageous storing properties thereof and easy-to-dispense nature of the package by simply peeling the laminated material from the base member enabling a user to gain ready access to the contact lens which is contained in the cavity of the base member. For example, a blister package which is adapted to provide a sterile sealed storage environment for a disposable, essentially single-use hydrophilic contact lens, which is normally worn for about 8 to 16 hours within a 24-hour period, wherein the lens is immersed in a sterile aqueous solution within the package is described in U.S. Pat. No. 4,691,820 to Martinez; which is commonly assigned to the assignee of the present application, and the disclosure of which is incorporated herein by reference.

In the above-mentioned U.S. patent, the blister package for storing and dispensing a hydrophilic contact lens includes an injection-molded or thermoformed plastic base portion or member incorporating a molded cavity which is surrounded by an outstanding planar flange extending about the rim of the cavity. A flexible cover sheet, such as a laminated foil is adhered to the surface of the flange so as to sealingly enclose the cavity in a generally liquid-tight manner. The surface of the covering foil may constitute a label and be imparted suitable printing indicia informative of the product stored in the blister package, the name and address of the manufacturer, and also incorporate various decorative designs and logos as desired; and also provide for changeable information, such as lot numbers, expiration dates and the like in addition to the foregoing, such as may be required by FDA regulations.

The foregoing blister packages are generally sold as individual or single units and the imprinted information provided thereon is complete for each blister package.

However, when it is intended to sell arrays or multiples of such detachably interconnected blister packages, each containing respectively a single hydrophilic contact lens, the opportunity may arise for a diverter to pass off the relatively inexpensive disposable product contained in each of the respective detached blister packages as a more expensive single unit item. In essence, such single-use or disposable contact lenses could be conceivably passed off as more expensive reusable contact lenses, potentially causing significant economic losses to the manufacturer and sellers, while also raising the possibility of potential legal liabilities in the event that the product is not properly used or worn for extended periods of time so as to result in physical harm to a user.

At this time, this potential problem of unlawful or illegal conversion arises through the development of a new and unique conception packaging arrangements of the blister package type, particularly for the containment of hydrophilic contact lenses in a sterile aqueous solution, wherein a plurality of base members each having a cavity for containing a hydrophilic contact lens in a sterile aqueous solution are adapted to be positioned in a contiguous array and sealing covered by a single or unitary flexible cover sheet, the latter of which is preferably in the form of a multi-layered flexible foil laminate. In this instance, the laminated foil is provided with weakening lines intermediate each of the respective base members so as to enable individual segments of the foil member to be detached along the weakening lines and in conjunction with the therewith associated base member to be separated from the array when it is desired to gain access to the contact lens contained therein. This type of arrayed multiple interconnected blister package structure enables the compact packaging of a plurality of such arrays, each possessing a specified number of contact lens-containing base members interconnected by a single flexible cover sheet, within the confines of a suitable container, such as a rigid paperboard carton. In the carton there may be compactly stored a plurality of nested superimposed arrays of blister packages; for example, each array having five interconnected blister packages each having a single disposable contact lens housed therein. The carton may store six superimposed arrays of blister packages, for a total of thirty; or in effect, a 30-day supply of contact lenses for respectively one eye of a user. A packaging arrangement for contact lenses of that type which is in the form of arrays of interconnected blister packages is disclosed in applicant's copending U.S. patent application Ser. No. 08/146,754, entitled "Packaging Arrangement for Contact Lenses" (Attorney Docket No. 9014; VTN-0090), now abandoned which is commonly assigned to the assignee of the present application and the disclosure of which is incorporated herein by reference.

The blister packages which are formed by means of this structure comprise a plurality of contiguously arranged thermoformed or injection-molded base members each containing a cavity for housing a hydrophilic contact lens in a sterile aqueous solution, and wherein the resultant array of such base members; for example, five (5) base members, is adapted to be sealingly covered and interconnected by a single multi-layered flexible laminated foil which also forms a common label, preferably of the type disclosed in applicant's copending U.S. patent application Ser. No. 08/106,386, filed Aug. 13, 1993, entitled "Method of Double-Sided Printing of a Laminate and Product Obtained Thereby"; (Attorney Docket No. 9013; VTN-0098) commonly assigned to the assignee of the present application, and the disclosure of which is incorporated herein by reference.

In the foregoing disclosure, the multi-layered laminated foil includes an outer layer of a plastic film material of a suitable polyolefin, preferably but not necessarily polyester, which is adhesively bonded to the surface of a supporting metallic foil, such as aluminum, or alternatively, in lien of the foil may be coated with a layer of silicon oxide, and in which the outer layer is double-sided printed; in effect, on both opposite surfaces. The surface of the outer plastic film layer which faces towards and is adhered to the metallic foil (or silicon oxide) is imprinted with suitable indicia and legends which may consist of permanent information regarding the manufacturer and the product, logos, instructive material, and decorative and advertising indicia relative the product in the blister package; whereas the opposite or exterior surface of the outer plastic film material layer may include suitable changeable information, such as expiration dates, lot numbers, fitting parameter, and other data specific to the packaged product. The interior surface of the outer plastic film material layer may be imprinted through the intermediary of suitable lithographic printing, either in single color or multi-colors and also provided with an appropriate printed background; whereas the changeable information specific to the product which is imprinted on specific areas of the outwardly facing surface of the outer film layer, may be printed thereon through thermal transfer printing, as described in detail in the above-referenced copending U.S. patent application Ser. No. 08/106,386.

Although the above-mentioned U.S. patent to Martinez, and the copending patent applications have to a considerable extent advanced the technology relative to the manufacture of blister packages for housing hydrophilic contact lenses; and wherein in particular U.S. patent application Ser. No. 08/106,386 provides a novel array of interconnected blister packages for storage in predetermined quantities within a carton structure, potential financial and legal problems can be encountered with regard to the possibility of diverters separating individual blister packages from the interconnected arrays thereof, and unlawfully passing these off as more expensive products in an unauthorized or unlawful sale of such items.

SUMMARY OF THE INVENTION

In order to thwart and aid in suppressing such potential misuse in the passing off and, in essence, converting the blister packages which are interconnected in an array by the unitary laminated foil structure, into separable and discrete blister packages, the invention contemplates the application of a novel printing pattern on the surface of the multi-layered laminated foil structure which forms a common label and covering lid for a plurality of base members, in which the printed pattern consisting of permanent data, such as indicia and suitable legends, consisting of a member of the class of grammatical constructs which are indivisible without loss of meaning, generally representative of the manufacturer, manufacturer's logo, miscellaneous product information and/or instructions of use and decorative and advertising indicia is imprinted in such a manner as to be spread over the surface of the laminated foil structure across the array of the containers or base members housing the contact lenses. Upon separation of the laminated foil along the weakening lines formed therein in order to provide individual detached segments each forming a blister package possessing one base member, this specially configures printed label aspect will provide visual evidence, such as by illustrating a discontinuity in the printing pattern, that the package arrangement being sold may have been unlawfully converted. In essence, the printed pattern representing permanent information is spread out in a manner such that any particular legend or indicia generally extends across the weakening lines formed in the laminated foil between adjacent base members of arrayed blister packages, thereby providing visual indication that separation from an array has been implemented, and the sale of such an item may be questionable in nature.

Required basically on each separate label for each blister package is information regarding the identifying of the manufacturer, the lot, batch and power of the particular contact lens contained therein, as necessitated by FDA (Food & Drug Administration) regulations. The expiration date, lot, batch fitting parameter and lens power information is independent of the permanent information which is printed as a common label spread out over the array of blister packages, and is variable in informative nature in conformance with the contents of a particular packaged item. Thus, when a single package is separated, it bears only the lot, batch and fitting parameter or power number, and no longer bears the complete identity of the manufacturer, and thus is no longer in conformance with the FDA regulations.

Another aspect of the present invention resides in the unique formation of micro-perforations in the multi-layered laminated material structure producing the weakening lines enabling separation of individual blister packages from the array, in which such perforations in one embodiment are formed in a novel manner by cutting only partially into the laminate at the side thereof which is adapted to be adhesively fastened or bonded to the base members; or permanent to an alternate embodiment entirely through the laminate from the opposite side thereof.

Accordingly, it is an object of the present invention to provide a novel laminated material structure for interconnecting and producing a label for a plurality of containers, such as base members of blister packages, wherein a predetermined pattern of printing is spread over the surface of the laminate structure so as to produce visual evidence of separation and detachment of segments of the laminate structure and therewith associated blister packages from the remaining array to thwart a potential diverter of the product in the blister packages.

Another object of the present invention resides in the provision of an array of blister packages of the type described in which the printing pattern imparted to the surface of the single multi-layered laminated material structure interconnecting the various blister packages and forming a common label for the array extends across weakening lines formed in the laminate whereby, upon separation of the laminate into individual segments along the weakening lines, this supplies visual evidence that the detached segment is a portion of an array of blister packages having a specific kind of product.

Yet another object of the present invention is to provide a novel slitting concept for the forming of the weakening lines in the multi-layered laminated material through the intermediary of micro-perforations penetrating at least partially through the thickness of the laminate to enable separation thereof into segments of individual blister packages, without affecting the integrity of the packages.

BRIEF DESCRIPTION OF THE DRAWINGS

The foregoing objects and other advantages and features of the invention may now be more readily ascertained from the following detailed description of a preferred embodiment thereof, taken in conjunction with the accompanying drawings; in which.

DETAILED DESCRIPTION OF A PREFERRED EMBODIMENT

Figure 1:
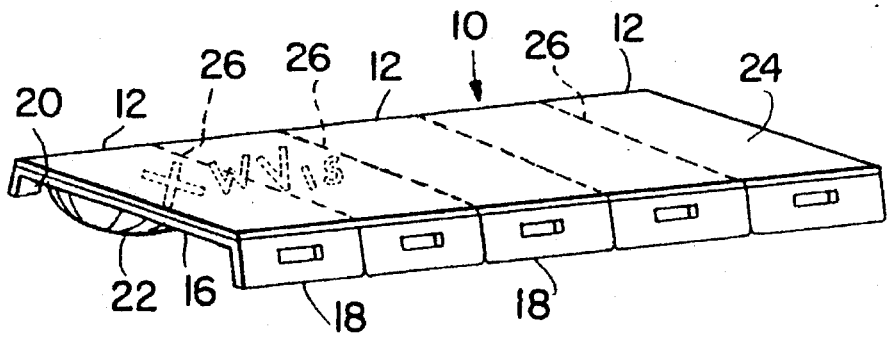
FIG. 1 illustrates, in a perspective view, an array constituted of a plurality of blister packages detachably interconnected by a single label-forming laminated material, each package containing respectively one contact lens immersed in a sterile aqueous solution.
Figure 2:
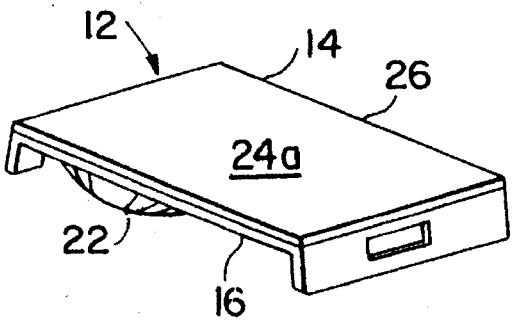
FIG. 2 illustrates a perspective view of one of the blister packages of FIG. 1, shown as having been separated from the array of blister packages.
Figure 3:
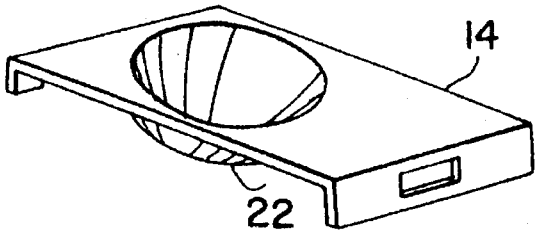
FIG. 3 illustrates the base member of the blister package of FIG. 2, with the cover sheet having been peeled off therefrom to enable access to a contact lens contained in a cavity formed in the base member of the blister package.

Referring now in more specific detail to the drawings, and in particular to FIGS. 1 to 3, there is illustrated an array of blister packages constructed pursuant to the present invention.

In essence, FIG. 1 illustrates the array of packaging arrangements 10 as consisting of a plurality of interconnected blister packages 12, wherein each blister package 12, as represented in further detail in FIGS. 2 and 3 of the drawings, includes a base member 14 consisting of a planar essentially rectangularly-shaped flange 16 having an integral depending wall portion 18 at one edge thereof. Offset towards an opposite edge 20 of the flange 16, a cavity 22 is formed in the flange which may be of an essentially semi-spherical configuration, generally in conformance with the curvilinear shape of a contact lens (not shown) although numerous other changes readily lend themselves to the invention, adapted to be stored therein in a sealed condition while immersed in a suitable sterile aqueous solution. The height of the wall portion 18 depending from the planar flange 16 is somewhat analogous to the height or depth of the cavity 22 containing the contact lens.

Basically, the foregoing construction of the array 10 of the blister packages is as described in the copending U.S. patent application Ser. No. 08/146,754 (Attorney Docket No. 9014; VTN-0090).

Hereby, the base member 14 of each so-called blister package 12 is constituted from an injection-molded or thermoformed plastic sheet material; for instance, such as polypropylene, in a manner similar to that described in U.S. Pat. No. 4,691,820 to Martinez; which is assigned to the common assignee of the present application, and the disclosure of which is incorporated herein by reference.

Positioned to extend over the base members 14 of the plurality of blister packages 12, in this case forming an array 10 of five (5), is a unitary label-forming and imprinted flexible cover sheet 24, as shown in detail in FIGS. 4 through 6, having a series of parallel spaced weakening lines 26, such as perforations, discontinuous slits or the like, as described more specifically hereinbelow, provided to extend between each of the adjacently located base members 14, so as to enable suitable detachment from the array 10 of individual or single blister packages 12 each containing a single contact lens without affecting the integrity of the packages, as shown in FIG. 2, by tearing off a segment along a weakening line 26, in accordance with the need of a user. The flexible laminated material cover sheet 24 is adhesively fastened to suitable regions of the surface of the flanges 16 of the blister packages 12 facing the cover sheet, such as by heat sealing, so as to at least encompass each cavity 22 containing a contact lens immersed in the sterile aqueous solution, and to provide a sealing containment for each contact lens in its respective cavity. Other sealing locations may also be provided at locations as desired between the surface of the flexible cover sheet 24 facing the surface of the flange 16 so as to provide adequate regions of adherence therewith, while permitting various edge portions between these components 16, 24 to remain unattached to facilitate a finger-gripping engagement for separating or peeling off the severed segment of cover sheet from the detached base member 14 in order to gain access to the contact lens which is contained in the respective cavity 22 thereof.

The flexible cover sheet 24 is preferably constituted of a laminated foil structure possessing a polyester film on at least one external surface thereof adapted to contact the facing surface of the flange 36 so as to enable adhesive or heat-sealing bonding therewith, as mentioned hereinabove. However, in lieu of the foil there can be employed other materials, such as a layer of silicon oxide ($SiO_2$) while the polyester fiber may be replaced by a suitable polyolefin. The laminate constituting the flexible cover sheet 24 may be of a multi-layered laminate construction having suitable double-sided imprinting provided on the outer layer of polyester, for example, as disclosed in copending U.S. patent application Ser. No. 08/106,386.

Figure 4:
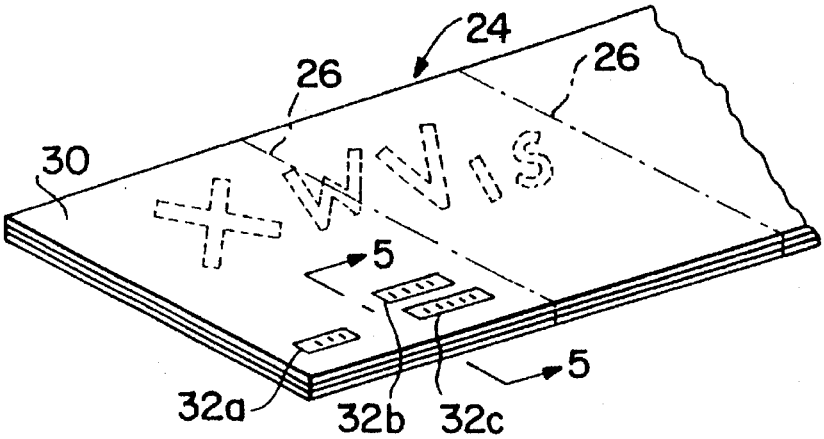
FIG. 4 illustrates a perspective view, on an enlarged scale, the laminated material covering for the array of blister packages of FIG. 1, showing the imprinting on the outer layer of the laminate.
Figure 5:
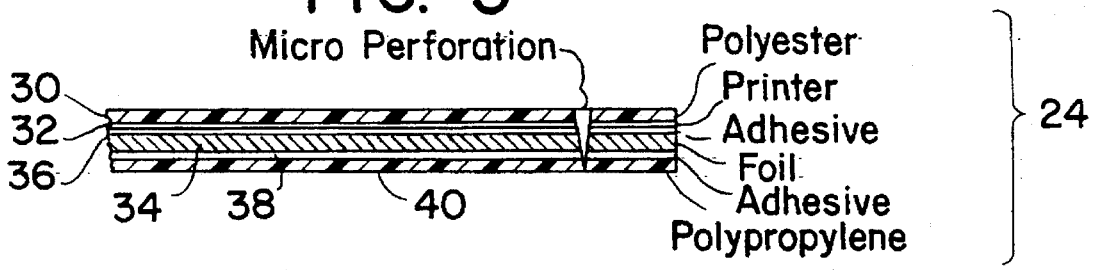
FIG. 5 illustrates, on an enlarged scale, a sectional view through an exemplary laminated material, taken along line 5—5 in FIG. 4, showing a micro-perforation extending therethrough.
Figure 6:
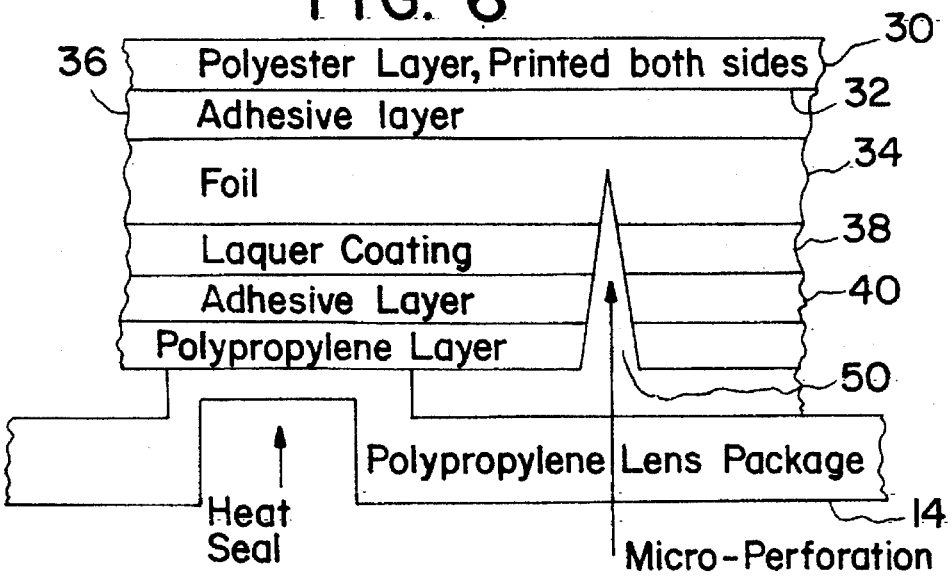
FIG. 6 illustrates, generally diagrammatically, a partially through-extending micro-perforation as imparted to the laminated material in order to produce weakening lines therein enabling separation of the foil into segments thereal-ong.

More specifically, the multi-layered laminate 24 is constituted of a plurality of layers of various materials which are adhesively secured or bonded to each other, as shown in detail in FIGS. 4 through 6 of the drawings, by way of example.

Reverting to FIG. 5, the multi-layered laminate 24 includes an upper layer 30 constituted of a substantially transparent or translucent polyestic film material, for instance polyester, which has been previously lithographically imprinted via conventional lithography on its lower surface 32 with suitable indicia, consisting of a member of the class grammatical constructs which are indivisible without loss of meaning, which may be in solid or colored halftones, including reversely printed legends as required, and which may also include a further color or print layer therebeneath forming a colorated or contrasting background, for instance, such as white or any other suitable color. Inasmuch as the indicia of halftones and the background beneath the polyester film web 30 are printed on interior surface 32, upon viewing from the outside towards the outer surface of the polyester film web 24, as shown in FIG. 4 of the drawings, in view of the transparency of the polyester film, visibly spread over the surface of the laminate 24 spanning the entire length of the array 10 are the various indicia and legends which may be representative of the company name, logo, various decorative and advertising matters and printed information which is to be permanently provided for products of this type in general, as desired. Additionally, suitable print fields 32*a*, 32*b* and 32*c* may be clearly ascertained and viewed from the exterior of the film layer 30. Imprinted onto the surface of the foil laminate 24 in superposition on the various print fields 32*a*, 32*b* and 32*c*, is the necessary information as required by FDA regulations specific to the lot, batch number, fitting parameter and lens power applicable to the product contained in the blister package. A foil web 34, preferably consisting of aluminum, or alternatively a barrier layer of silicon oxide among other suitable materials, extends adjacent the lower surface 32 of the polyester film and is adhesively secured or bonded thereto through the interposition of an adhesive layer constituted of a dry bonding adhesive 36, which may be polyurethane.

The other side or surface of the aluminum foil web 34 (or silicon oxide) may also be coated with a further adhesive layer 38 similar to that of adhesive layer 36, and which is also constituted of polyurethane. This adhesive is intended to provide an adhesive connection or bond between the lower surface of the aluminum foil web 34 and a further plastic film layer 40 which may be constituted of polypropylene, and which provides for a good sealing adherence or bonding to the plastic material of the injection-molded or thermoformed plastic container or base members 14; for instance, through heat sealing thereto or the like.

Prior to the forming of the adhesive bond between the surface 32 of the upper polyester film layer 30 and the adhesive 36 in order to laminate the layer 30 to the aluminum foil web 34, (or silicon oxide layer), suitable imprinting is implemented. This printing as mentioned hereinbefore, is imparted to the lower surface 32 of the polyester film 30 in that indicia and legends, as mentioned hereinbefore, are applied through lithographic printing in suitable orientation such that upon adhesive securing or bonding thereof to the foil 34, the imprinted indicia will be viewable through the layer 30 from the top of the laminate 24 in the correctly represented pattern thereof.

Pursuant to the inventive concept, in order to thwart potential diverters, the pattern of the permanently printed information on the lower surface 32 of the polyester film layer 30, consisting of a member of the class grammatical constructs which are indivisible without loss of meaning, is spread across the length of the laminated foil 24 extending the full length of the array 10 such that specific information which is indivisible without loss of meaning such as manufacturer's addresses and names, logos, product information of a permanent nature and the like overlap the weakening lines 26 formed in the flexible laminated foil 24; in effect, extend on both sides thereof above adjacent base members forming contiguously arranged blister packages 12 in conjunction with the overlying label-forming laminated foil, whereby separation of any particular blister package by detaching along a weakening line will divide the indicia pattern which is indivisible without loss of meaning and thereby provide visual information to a user that, possibly, the product has been unlawfully converted so as to represent a similar, but essentially more expensive product, such as a reusable rather than disposable contact lens. The pattern of printing of information a permanent nature which is not easily accessible from the exterior of the laminated foil, inasmuch as this printing is on the interior surface 32 of the outer plastic film material 30 which is adhesively fastened or bonded to the foil web 34, can only be tampered with by destroying the foil web. Thus, when separated, the individual package will no longer be in conformance with applicable FDA regulations inasmuch as the complete identity of the manufacturer will no longer be on the separated blister package. This, in effect, will then quite readily provide a conversion-resistant contact lens blister package 12, in which the specially imprinted and configured label in the form of the laminated foil is intended to securely thwart converters.

The changeable information with regard to the product contained in each blister package, such as lot numbers, expiration dates and contact lens power, may be separately printed within the printing areas 32*a*, 32*b* and 32*c* on the external surface of the plastic film web 30.

A further aspect of the invention, as shown in FIGS. 6 through 9 of the drawings relates to the formation of micro-perforations 50 in the flexible laminated foil 24 so as to form the weakening lines 26 enabling separation of portions 24*a* of the flexible laminated foil together with the thereto adhered base member 14, each jointly constituting an individual blister package 12 from the remaining array 10.

The novel micro-perforations may be imparted to the lower plastic film material layer normally constituted of polypropylene which is adapted to be sealed to the base member of each blister package of the array 10. The micro-perforations, which as shown in FIG. 6, may be imparted to the lower portion of the flexible foil laminate extend through the lower structure of the foil label without cutting into the outer polyester film layer 30.

The micro-perforation concept is employed inasmuch as the polypropylene layer 40 below the foil web 34, wherein the polypropylene layer is bonded to the base members 14 is essentially very strong and stretchable material, and is difficult to tear. In contrast therewith, the outer polyester layer 30 which is located on top of the foil web 34 is strong, but is inherently relatively brittle in nature. The forming of partially inwardly-extending slits to produce the micro-perforations forming the weakening lines 26 will not cut through the thickness of the laminated foil, as clearly shown in FIG. 6 of the drawings. However, as shown in FIG. 5, the micro-perforations may also extend through the entire thickness of the laminate from the exterior thereof, as imparted thereto by the knife, illustrated in FIG. 9 of the drawings.

Figure 8:
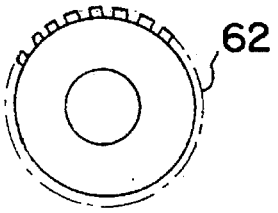
FIG. 8 illustrates a typical perforating blade employed in the apparatus of FIG. 7.
Figure 7:
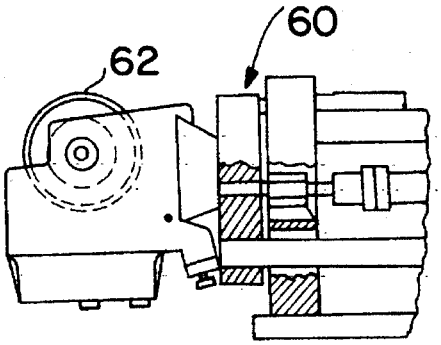
FIG. 7 schematically illustrates a side view of an apparatus for imparting the micro-perforations as in FIG. 6 to the laminated material to produce the weakening lines.

As schematically illustrated in FIGS. 7 and 8, there is disclosed an apparatus 60 including a cutting disc 62, or in effect, a plurality of cutting discs spaced commensurate with the number of parallel weakening lines 26 which have to be formed in the laminate 24 to provide such weakening lines across the width or length of the array 10 intermediate the base members 14. As illustrated in FIG. 8, this disc 62 may be a conventional cutting blade possessing 40 blades to the inch. Ordinarily, the blades may be urged against an anvil by means of an air cylinder which pushes the blades into the lower face of the laminated material 24, i.e. through layer 40 and into web 34. The pressure in the air cylinder may govern the depth of the cut producing the micro-perforations, to a depth generally one-half the thickness of the laminate material 24, and an off-line destructive test may be employed to adjust the air pressure as the blades dull during continued use in order to maintain control over the depth of the cut.

Figure 9:
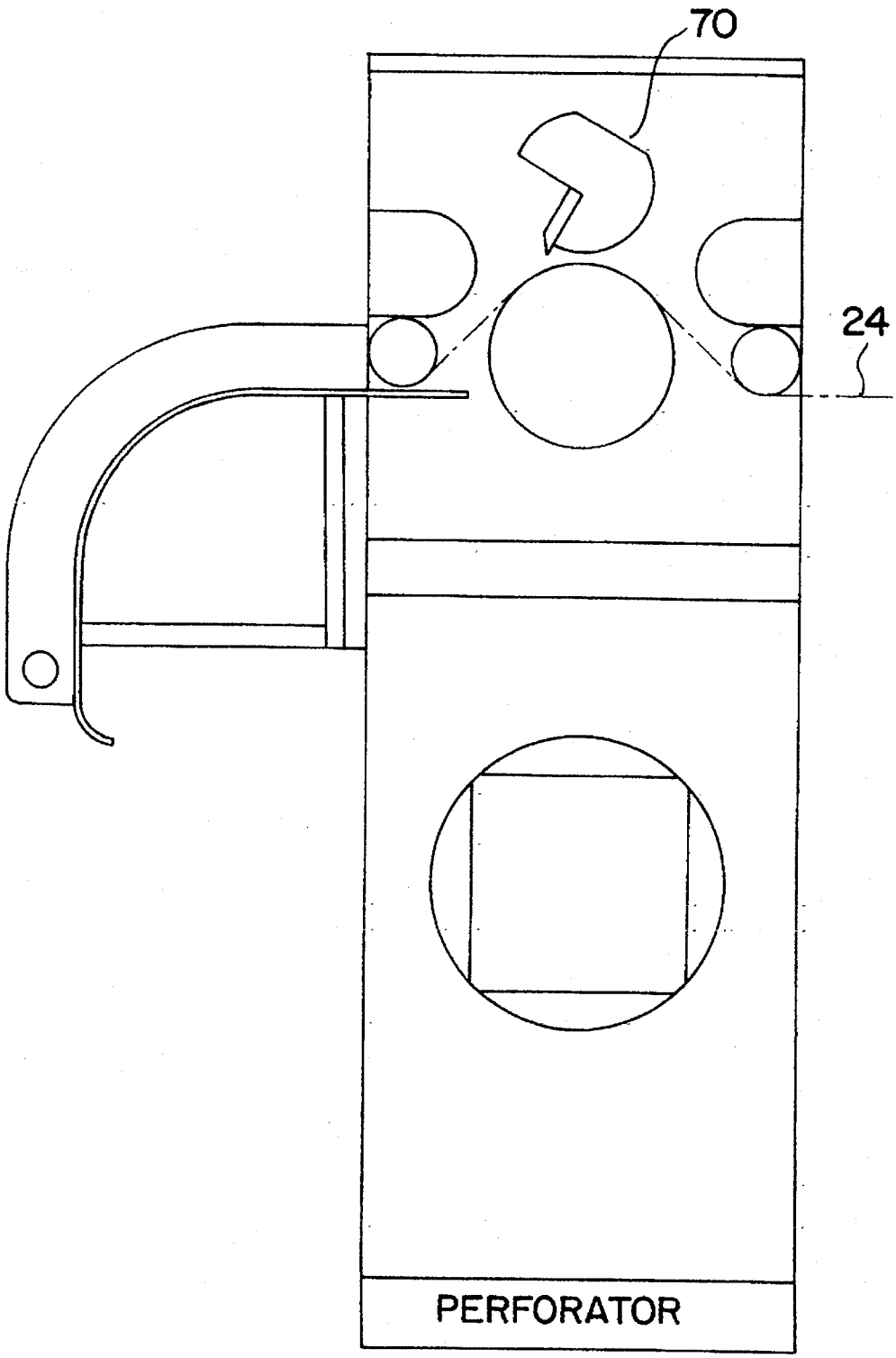
FIG. 9 illustrates another blade structure for producing the micro-perforations in the laminate as shown in FIG. 5.

Alternatively, as illustrated schematically in FIG. 9 of the drawings, there can be employed a flying knife 70 with is aligned on a cylindrical drum along the longitudinal axis of the cylinder and which cooperates with a suitable cylindrical anvil. As the label-forming laminate 24 passes through the drum, the longitudinal knife cuts through the thickness of the laminate, as in FIG. 5. This knife may be designed to perforate four label-forming laminate segments in sequence and then skip over a fifth inasmuch as the fifth cut would represent a complete severance of the label which is to be formed for the array 10 from the spooled supply of label material.

In essence, the present invention as described hereinabove sets forth a novel concept in imprinting labels constituted of laminated material webs forming sealing covers for arrays of blister packages; and also provides a novel concept in forming micro-perforations in the laminated material.

The foregoing structure is easily and completely packageable in cartons in a high-volume mass-production process. Moreover, the invention facilitates the user-friendly handling and storage of large numbers of contact lenses by physicians and patients in a highly organized and convenient manner.

While there has been shown and described what are considered to be preferred embodiments of the invention, it will, of course, be understood that various modifications and changes in form or detail could readily be made without departing from the spirit of the invention. It is, therefore, intended that the invention be not limited to the exact form and detail herein shown and described, nor to anything less than the whole of the invention herein disclosed as hereinafter claimed.

What is claimed is:

1. A laminated material structure comprising a unitary label, a covering, and an array of a plurality of contiguously arranged containers, said covering being coextensive with at least one side of said array, said laminated structure being separable into a plurality of segments each forming a separately sealed container, and said covering having an outer layer with a surface facing away from said side of said array and being imprinted with a specified pattern of indicia and legends extending over at least two contiguously arranged containers, said pattern consisting grammatical constructs which are indivisible without loss of meaning, such that separation of at least one said segment from said laminated structure divides said grammatical constructs and thereby provides visual evidence of separation from said laminated structure upon inspection of said pattern.

2. A laminated structure as claimed in claim 1, wherein said outer layer comprises a plastic film material having a surface adhesively fastenable to a facing surface of a web, said pattern of specified indicia and legends being imprinted on the surface of said film material facing said web.

3. A laminated structure as claimed in claim 2, wherein said web is comprised of silicon oxide.

4. A laminated structure as claimed in claim 2, wherein weakening lines are formed in said laminated structure to facilitate separation into said segments, said pattern of indicia and legends being printed on the laminated structure extending over said weakening lines such that predetermined regions of said patterns are divided at said weakening lines to form indication of discontinuities in said pattern upon separation of said segments.

5. A laminated structure as claimed in claim 4, wherein said weakening lines each comprise micro-perforations extending at least partially through said laminated structure to enable separating said structure into said segments along said weakening lines, said segments each forming respectfully a cover for one said container.

6. A laminated structure as claimed in claim 4, wherein said weakening lines comprise micro-perforations cut into said laminated structure opposite the side to which said outer layer of plastic film material is adhesively fastened to said web.

7. A laminated structure as claimed in claim 6, wherein said micro-perforations extend through said laminated structure.

8. A laminated structure as claimed in claim 6, wherein said web has a further plastic film material layer adhesively fastened to the surface of said web opposite the surface having the outer plastic film material adhesively fastened thereto.

9. A laminated structure as claimed in claim 8, wherein said further plastic film material layer is constituted of oriented polypropylene.

10. A laminated structure as claimed in claim 8, wherein said sealed containers are constituted of plastic material, and a releasable heat seal is formed between each said container and said further plastic film material layer.

11. A laminated structure as claimed in claim 8, wherein said micro-perforations extend through said further plastic film material layer into said web.

12. A laminated structure as claimed in claim 2, wherein said plastic film material layer is constituted of a polyolefin.

13. A laminated structure as claimed in claim 2, wherein said web is comprised of aluminum.

14. A laminated structure as claimed in claim 2, wherein said plastic film material is imprinted on two surfaces thereof, an outer surface of said film opposite said surface facing said web being imprinted with further indicia at specific regions over each respective sealed container.

15. A laminated structure as claimed in claim 14, wherein said further indicia is imparted to the outer surface of said plastic film material by thermal transfer printing.

16. A laminated structure as claimed in claim 1, wherein each said sealed container comprises an injection molded plastic base member of a blister package having a cavity for the sealed containment of a hydrophilic contact lens in a sterile aqueous solution.

17. A laminated structure as claimed in claim 16, wherein said cavity of each said base member is in sealing engagement with a superimposed segment of said laminated structure.

18. A laminated structure as claimed in claim 1, wherein said array of contiguously arranged containers comprises a linear array consisting of a specified number of said containers, said laminated structure having a generally rectangular configuration.

19. A laminated structure as claimed in claim 1, wherein said pattern is applied to said outer layer by lithographic printing.

20. A laminated structure as claimed in claim 1, wherein each said sealed container comprises a thermoformed plastic base member of a blister package having a cavity for the sealed containment of a hydrophilic contact lens in a sterile aqueous solution.

21. A packaging arrangement for the sealed containment of a plurality of hydrophilic contact lenses each in a sterile aqueous solution; comprising:

a) a plurality of molded plastic base members contiguously positioned in an array, each said base member having a cavity for containing one contact lens immersed in an aqueous solution, each said base member including a flange extending outwardly about the periphery of said cavity, and a flap extending from said flange; and b) a laminate comprising a unitary flexible cover sheet extending superimposed over said plurality of base members and detachably sealed to the surface of said flanges at least about the rim of each said cavity, said cover sheet comprising an outer layer imprinted to define a specified pattern of indicia and legends extending over a surface thereof, said laminate being separable into segments each forming respectively a cover for one associated base member, said pattern consisting of grammatical constructs which are indivisible without loss of meaning whereby separation of at least one said segment from the remaining laminate divides said grammatical constructs and thereby provides visual evidence of separation from said array upon inspection of said pattern.

22. A packaging arrangement as claimed in claim 21, wherein said outer layer comprises a plastic film material having a surface adhesively fastenable to a facing surface of a web, said pattern of specified indicia and legends being imprinted on the surface of said film material facing said web.

23. A packaging arrangement as claimed in claim 22, wherein said web is comprised of silicon oxide.

24. A packaging arrangement as claimed in claim 22, wherein weakening lines are formed in said to facilitate separation into said segments, said pattern of indicia and legends being printed on the structure extending over said weakening lines such that predetermined regions of said pattern are divided at said weakening lines to form indication of discontinuities in said pattern upon separation of said segments.

25. A packaging arrangement as claimed in claim 24, wherein said weakening lines each comprise micro-perforations extending into said laminate to enable separating said laminate into said segments along said weakening lines, said segments each forming respectively a cover for one said base member.

26. A packaging arrangement as claimed in claim 24, wherein said weakening lines comprise micro-perforations cut to extend at least partially through said laminate opposite the side to which said outer layer of plastic film material is adhesively fastened to said web.

27. A packaging arrangement as claimed in claim 26, wherein said web has a further plastic film material layer adhesively fastened to the surface of said web opposite the surface having the outer plastic film material layer adhesively fastened thereto.

28. A packaging arrangement as claimed in claim 27, wherein said further plastic film material layer is constituted of oriented polypropylene.

29. A packaging arrangement as claimed in claim 27, wherein said base members are constituted of plastic material, and a releasable heat seal is formed between each said base member and said further plastic film material layer.

30. A packaging arrangement as claimed in claim 27, wherein said micro-perforations extend through said further plastic film material layer into said web.

31. A packaging arrangement as claimed in claim 22, wherein said plastic film material is constituted of a polyolefin.

32. A packaging arrangement as claimed in claim 22, wherein said web is comprised of aluminum.

33. A packaging arrangement as claimed in claim 22, wherein said plastic film material is imprinted on two surfaces thereof, an outer surface of said plastic film material opposite said surface facing said web being imprinted with further indicia at specific regions over each respective base member.

34. A packaging arrangement as claimed in claim 33, wherein said further indicia is imparted to the outer surface of said plastic film material by thermal transfer printing.

35. A packaging arrangement as claimed in claim 21, wherein each said base member comprises an injection molded plastic base member of a blister package having a cavity for the sealed containment of a hydrophilic contact lens in a sterile aqueous solution.

36. A packaging arrangement as claimed in claim 35, wherein said cavity of each said base member is in sealing engagement with a superimposed segment of said laminate.

37. A packaging arrangement as claimed in claim 21, wherein said array of contiguously arranged base members comprises a linear array consisting of a specified number of said base members, said laminate having a configuration covering said array.

38. A packaging arrangement as claimed in claim 21, wherein said pattern is applied to said outer layer by lithographic printing.

39. A packaging arrangement as claimed in claim 21, wherein each said base member comprises a thermoformed plastic base member of a blister package having a cavity for the sealed containment of a hydrophilic contact lens in a sterile aqueous solution.

* * * * *

UNITED STATES PATENT AND TRADEMARK OFFICE

CERTIFICATE OF CORRECTION

PATENT NO. : 5,620,087

DATED : April 15, 1997

INVENTOR(S) : Martin et al.

It is certified that error appears in the above-indentified patent and that said Letters Patent is hereby corrected as shown below:

Column 11 - Line 40 - insert "laminate" after said

Signed and Sealed this

Fourteenth Day of October, 1997

*Attest:*

*Attesting Officer*

BRUCE LEHMAN

*Commissioner of Patents and Trademarks*